US010610768B2

(12) United States Patent
Starr

(10) Patent No.: US 10,610,768 B2
(45) Date of Patent: Apr. 7, 2020

(54) DIGITIAL MULTILINGUAL WORD BUILDING GAME

(71) Applicant: Carder Starr, Narragansett, RI (US)

(72) Inventor: Carder Starr, Narragansett, RI (US)

( * ) Notice: Subject to any disclaimer, the term of this patent is extended or adjusted under 35 U.S.C. 154(b) by 1065 days.

(21) Appl. No.: 13/888,519

(22) Filed: May 7, 2013

(65) Prior Publication Data

US 2014/0335926 A1 Nov. 13, 2014

(51) Int. Cl.
*A63F 3/04* (2006.01)
*A63F 9/24* (2006.01)

(52) U.S. Cl.
CPC ..... *A63F 3/0421* (2013.01); *A63F 3/0402* (2013.01); *A63F 3/0423* (2013.01); *A63F 2003/0428* (2013.01); *A63F 2009/246* (2013.01)

(58) Field of Classification Search
CPC .. A63F 3/00643; A63F 3/0402; A63F 3/0405; A63F 3/0421; A63F 3/0423; A63F 3/0424; A63F 3/0425; A63F 3/0426; A63F 3/0427; A63F 3/0428; A63F 3/0429; A63F 3/043; A63F 3/0431; A63F 9/0098
USPC ..... 715/234
See application file for complete search history.

(56) References Cited

U.S. PATENT DOCUMENTS 4,336,020 A * 6/1982 Zacharin ..... A63F 9/10 273/157 R
4,715,608 A * 12/1987 Burt ..... A63F 3/0423 273/248
4,973,058 A * 11/1990 Breen ..... A63F 9/0098 273/240
5,149,097 A * 9/1992 Tonello ..... A63F 3/0423 273/148 R
5,314,191 A * 5/1994 Mayas ..... A63F 3/0423 273/272
5,921,864 A 7/1999 Walker et al.
8,057,233 B2 * 11/2011 Owen ..... G09B 5/06 172/176
8,070,163 B2 * 12/2011 Ogilvie ..... A63F 3/00643 273/272
8,523,574 B1 * 9/2013 Juranka ..... G09B 19/06 434/156
2002/0119812 A1 * 8/2002 Letang ..... A63F 3/0423 463/9

(Continued)

FOREIGN PATENT DOCUMENTS

WO 8908483 A1 9/1989
WO 0184367 A1 11/2001

OTHER PUBLICATIONS

Mattel Games, "How to Play Scrabble," 2003.*

(Continued)

*Primary Examiner* — Andrew R Dyer

(57) ABSTRACT

The word building games system, apparatus, carrier, method, and process provides a plurality of characters comprising at least a first language and a second or different language. The characters of the first language and the characters of the second or different language are used non-simultaneously. A playing environment comprises a plurality of character areas. The character areas include one or more change language areas. During game play, if the characters selected from the first language engages the one or more change language areas, the characters from the second or different language are subsequently used to build a word.

3 Claims, 4 Drawing Sheets

(56) References Cited

U.S. PATENT DOCUMENTS

2003/0080509 A1* 5/2003 Chaisanit ..... A63F 3/00697 273/272
2003/0139210 A1 7/2003 Raben
2004/0077399 A1* 4/2004 Marshall ..... A63F 3/062 463/19
2004/0157655 A1* 8/2004 Tsugiiwa ..... A63F 13/10 463/9
2005/0225030 A1* 10/2005 Baldry ..... A63F 3/04 273/248
2006/0197285 A1 9/2006 McNeill
2007/0026375 A1* 2/2007 Dewey ..... G09B 5/00 434/350
2008/0265506 A1 10/2008 Benedict
2008/0265508 A1* 10/2008 Benedict ..... A63F 3/0423 273/272
2008/0311546 A1 12/2008 Wang
2009/0191520 A1* 7/2009 Viriyala ..... G09B 19/06 434/159
2010/0041456 A1 2/2010 Yu
2010/0113148 A1* 5/2010 Haltovsky ..... G06F 1/1626 463/30
2011/0107239 A1* 5/2011 Adoni ..... A63F 13/12 715/757
2011/0133405 A1* 6/2011 Ogilvie ..... A63F 3/00643 273/272
2011/0205161 A1* 8/2011 Myers ..... G06F 3/016 345/169
2011/0230246 A1* 9/2011 Brook ..... A63F 3/0421 463/9
2012/0007312 A1 1/2012 Ogilvie
2012/0252557 A1 10/2012 Chow et al.
2013/0127116 A1* 5/2013 Cummings ..... A63F 3/0423 273/299
2013/0244784 A1* 9/2013 Assa ..... G06F 3/0488 463/40
2013/0292904 A1* 11/2013 Severance ..... A63F 3/0423 273/272
2014/0011557 A1* 1/2014 Coyle ..... A63F 13/80 463/9
2014/0106835 A1* 4/2014 Small ..... A63F 13/12 463/9
2014/0131945 A1* 5/2014 McClung, III ..... A63F 3/0423 273/272
2014/0217673 A1* 8/2014 Severance ..... A63F 9/0098 273/299
2014/0327209 A1* 11/2014 Mizanoski ..... A63F 3/0423 273/272

OTHER PUBLICATIONS

Miller, "Tower of Scrabble," 2007, available at: [http://www.washingtonpost.com/wp-dyn/content/article/2007/09/14/AR2007091401974.html.*
Rajat et al., "Scrabble for the Apple iPad," 2010, available at: [https://www.youtube.com/watch?v=VdUznE15L30].*
Jessica Dickinson Goodman, "How to Make Your Own Arabic/English Scrabble Set in 5 Steps," FeelingElephants, Sep. 2, 2011, jessicadickinsongoodman.com, pp. 1-6. (Year: 2011).*
Jessica Dickinson Goodman, "Proposed Rules for Arabic/English Scrabble," FeelingElephants, Jan. 17, 2011, jessicadickinsongoodman.com, pp. 1-3. (Year: 2011).*

* cited by examiner

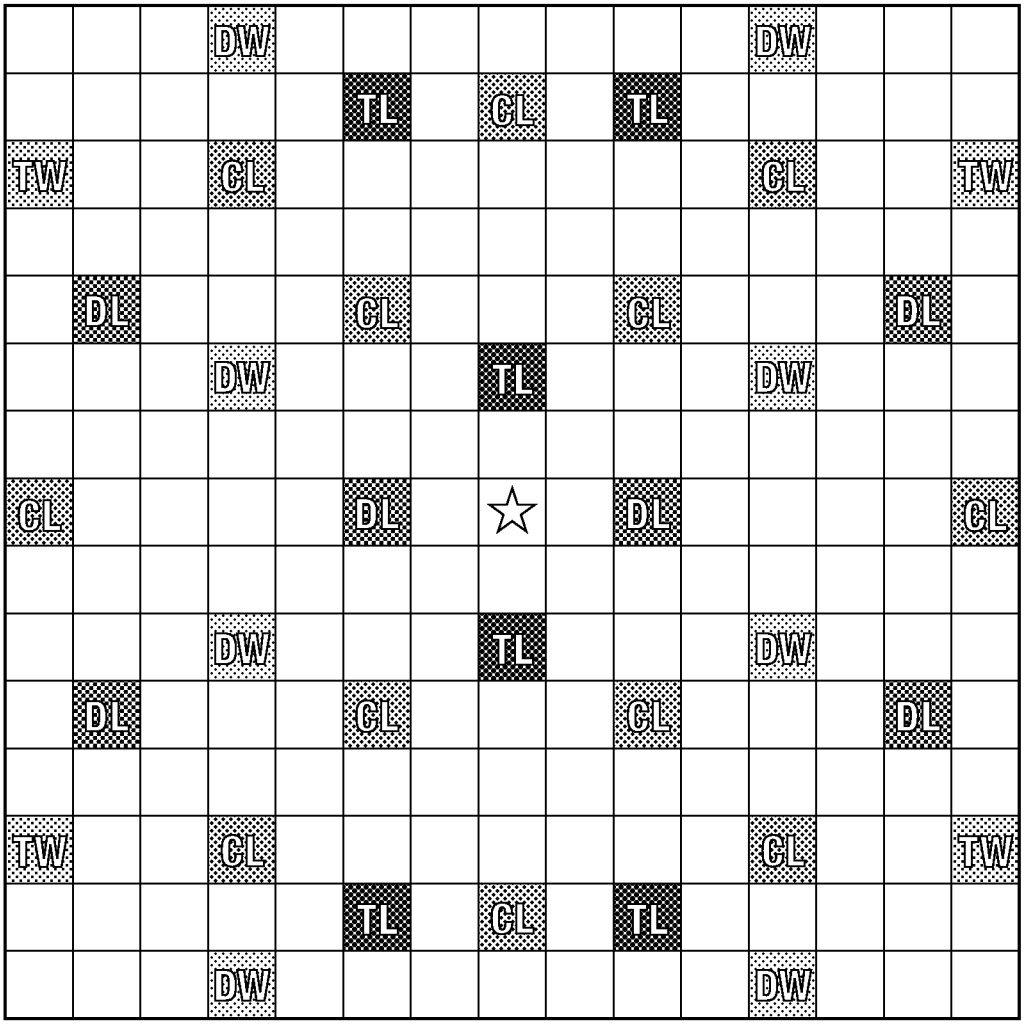

Fig. 1

Example of a playing grid for Digital Multilingual Word Building Game
The Change Language Squares represent the primary distinguishing characteristics of this invention. The other bonus squares are included for comparative and possible design purposes.

CL = change language
DL = double letter value
DW = double word value
TL = triple letter value
TW = triple word value

DIGITIAL MULTILINGUAL WORD BUILDING GAME

CROSS REFERENCE TO RELATED APPLICATION

This non-provisional patent application is related to and claims priority from earlier filed, U.S. Provisional Patent Application No. 61/688,118 filed May 7, 2012, all of which is incorporated herein by reference.

BACKGROUND OF THE INVENTION

The present invention provides a method, system, process, carrier, and apparatus for a word building game. In particular, the word building games method, system, process, carrier, and apparatus provides a plurality of characters comprising at least a first language and a second or different language. The characters of the first language and the characters of the second or different language are used non-simultaneously. A playing environment comprises a plurality of character areas. The character areas include one or more change language areas. During game play, if the characters selected from the first language engages the one or more change language areas, the characters from the second or different language are subsequently used to build a word.

Language functions to facilitate the expression or communication by means of symbols. The level of education of a person is predicated often on the command of language, especially in the person's native country. It often takes years of practice and reinforcement through education and use to attain language proficiency in a single language. To command more than one language, especially languages not indigenous to the person, it takes even more time and attention which is less frequently achieved by the average person.

Word games are often designed to hone language ability and to playfully explore its complexities while building language skills. Word games are usually employed as a source of cherished entertainment, and have been further discovered to serve a teaching purpose with regards to language. For example, players can find happiness playing word building games such as Scrabble®, while organically developing functional language skills like spelling. In fact, word building games are a pastime that many players have long attributed to keeping their minds focused and clear.

Many word games enjoy international appeal across a multitude of languages, but are primarily directed to a single native language of use during play. Word games have been designed in the past; however, previous word games were designed so that each spelled word is in the same language throughout the course of game play, such as English. For example, some versions of Scrabble® are played in multiple languages, but only one language at a time is used, with all players making words in the same language. This approach limits players in learning only a single language, most likely their native tongue.

Therefore, there is a desire to improve the existing word games so that more than one language may be used during the course of the word game in a dynamic way so that players can expand their vocabulary beyond their native tongue while having fun.

BRIEF SUMMARY OF THE INVENTION

The present invention provides a method, system, process, and apparatus for a word building game. In particular, the method, system, process, and apparatus provides a digital or non-digital multilingual word building game. A word building game system provides a plurality of characters comprising at least a first language and a second or different language. In one embodiment, the plurality of characters are letters or symbols. The characters of the first language and the characters of the second or different language are used non-simultaneously. A playing environment comprises a plurality of character areas. The character areas include one or more change language areas. In one embodiment, the playing environment is a playing grid having a plurality of character areas defining a plurality of square shapes. The system may be operated in a digital environment, non-digital environment, online environment, or a combination of both. In another embodiment, the system is in electronic form, and further comprises computer program instructions that instruct a computing device to display at least the playing environment and characters and respond to user actions. During game play, if the characters selected from the first language engages the one or more change language areas, the characters from the second or different language are subsequently used to build a word.

A method of playing the word building game comprises one or more of the following steps. A first player receives characters comprising at least a first language and a second or different language. The characters of the first language and the characters of the second or different language are used non-simultaneously. The first player forms a word from the characters using the first language to form the word within a playing environment having a plurality of character areas. The plurality of character areas include one or more change language areas. A point value is counted for the word based on the numeric value of the characters used in the word. During game play, if the characters selected by the first player from the first language engages the one or more change language areas, the characters from the second or different language are subsequently used by a second player to build a word.

A computer-readable carrier contains instructions thereon for instructing a computing device to implement a word building game. For example, the carrier may be a DVD. The instructing includes one or of the following steps. A plurality of characters is provided comprising at least a first language and a second or different language. The characters of the first language and the characters of the second or different language are used non-simultaneously. The characters are distributed to the two or more players. In one embodiment, there are a range of players from one to four or even more. The characters are received from the players to form a word using a first language to form the word within a playing environment having a plurality of character areas. The plurality of character areas including one or more change language areas. A point value is counted for the word based on the numeric value of the characters used in the word. If the characters selected from the first language engages the one or more change language areas, the characters from the second or different language are subsequently used to build a word.

A computing apparatus provides a word building game. The computer apparatus is configured to provide the following steps. In one embodiment, the computer apparatus is selected from a group consisting of: smart phone, mobile phone, tablet, laptop, desktop computer, handheld device, portable device, server, and other electronic devices configured to operate a word building game. First, a plurality of characters comprising at least a first language and a second or different language are provided. The characters of the first language and the characters of the second or different language are used non-simultaneously. The characters are distributed to two or more players. The characters are received from the players to form a word using a first language within a playing environment having a plurality of character areas. The plurality of character areas include one or more change language areas. A point value is counted for the word based on the numeric value of the characters used in the word. During game play, if the characters selected from the first language engages the one or more change language areas, the characters from the second or different language are subsequently used to build a word.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

FIG. 1 shows a top view of an example of a playing grid with squares for the multilingual word building game of the present invention;

DETAILED DESCRIPTION OF THE PREFERRED EMBODIMENTS

Referring generally to FIGS. 1-7, the present invention provides a method, system, process, carrier, and apparatus for a digital or non-digital multilingual word building game. In particular, the word building games method, system, process, carrier, and apparatus provides a plurality of characters comprising at least a first language and a second or different language. The characters of the first language and the characters of the second or different language are used non-simultaneously, or sequentially. A playing environment comprises a plurality of character areas. The character areas include one or more change language areas.

More specifically, the method, system, process, and apparatus provides a digital or non-digital multilingual word building game where a forced change of language occurs during play, requiring the next player to build a word in a new language. Referring to FIG. 1, the board, playing grid, or playing environment has several 'change language' squares, and when a letter tile is placed on this change language square, a change of language is forced. The new language remains until another 'change language' square is crossed. Letter tiles are assigned to players dependent on the chosen game languages, and language-specific tiles may be used within their language.

Figure 2:
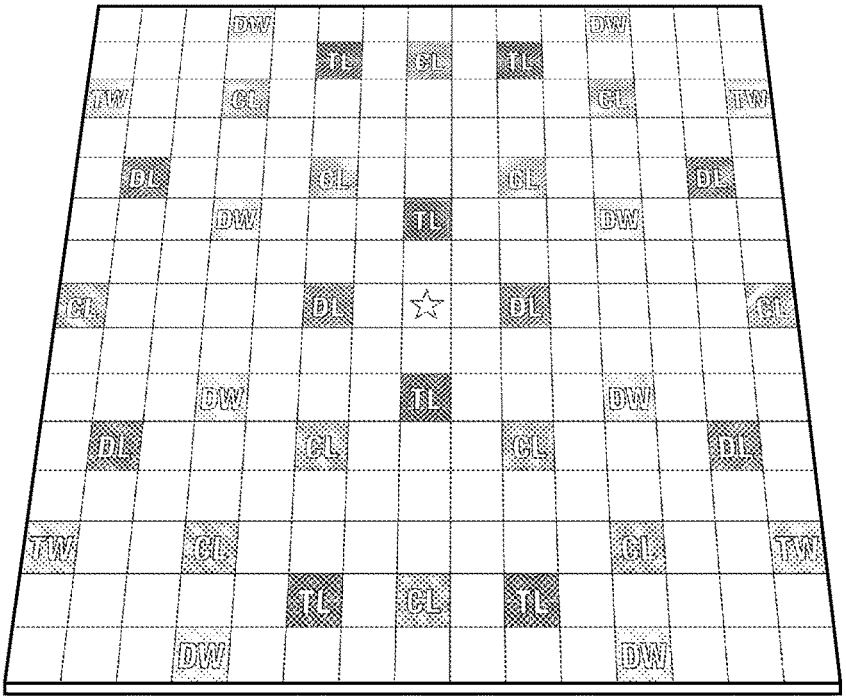
FIG. 2 shows a perspective view of the playing grid with squares for the multilingual word building game of the present invention.
Figure 3:
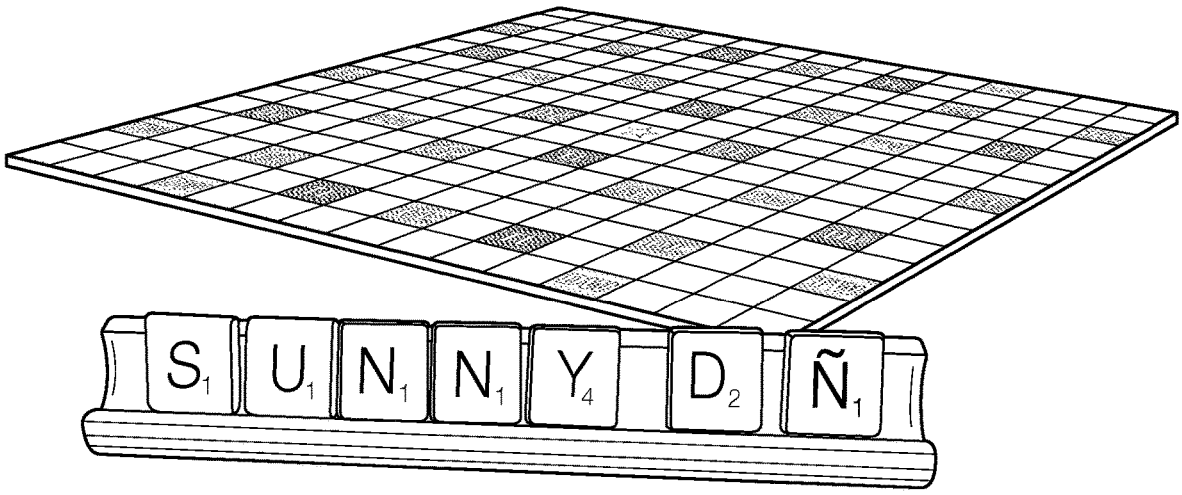
FIG. 3 shows the playing grid of FIG. 2 along with language tiles from one or more languages.
Figure 4:
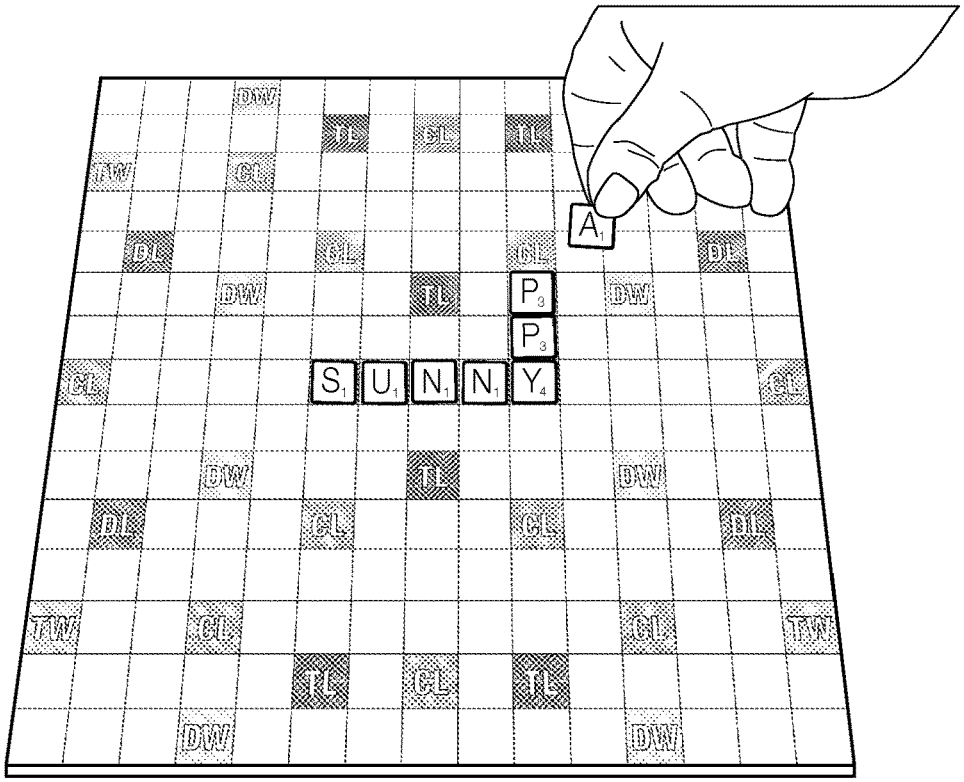
FIGS. 4-5 shows the playing grid of FIG. 2 during game play where a CL (change language) square is covered changing the language from English to Spanish.
Figure 5:
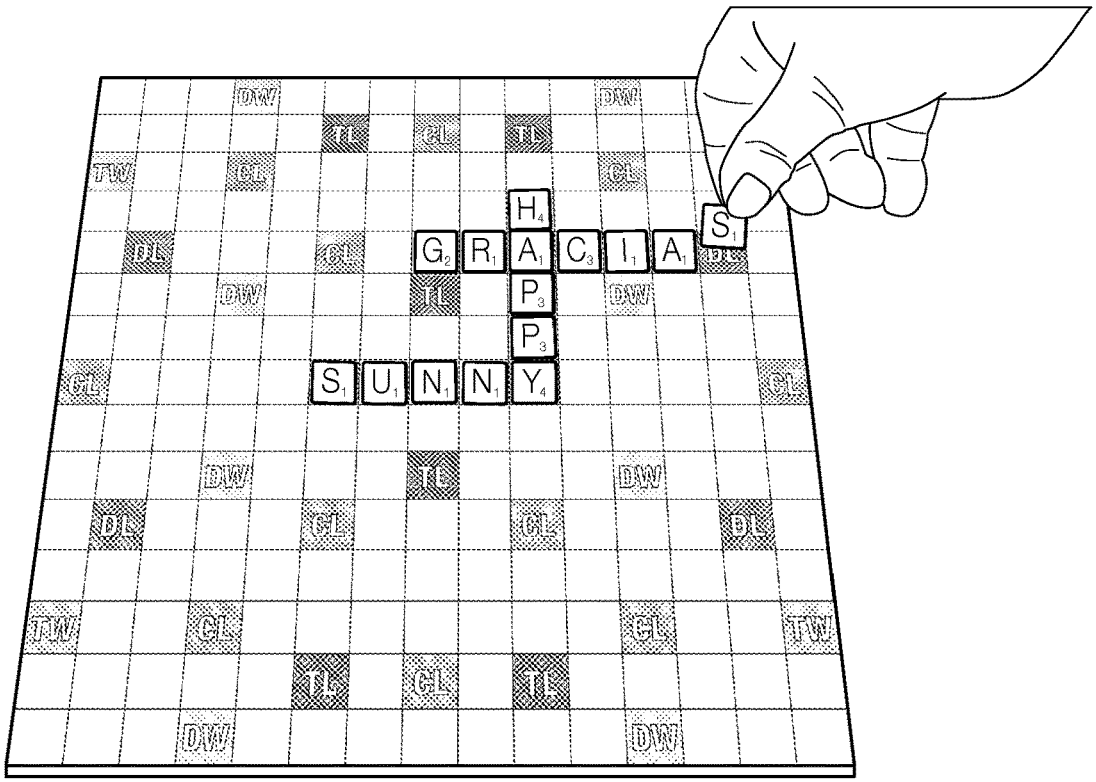
Figure 6:
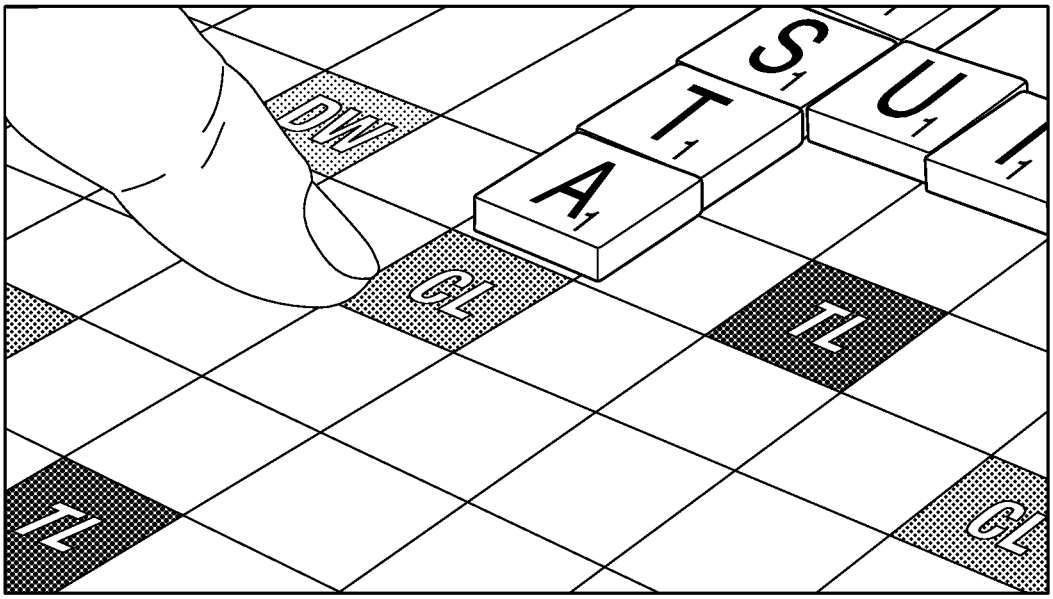
FIGS. 6-7 shows the playing grid of FIG. 2 during game play where the CL square is covered again changing the language from Spanish to English on the next turn.
Figure 7:
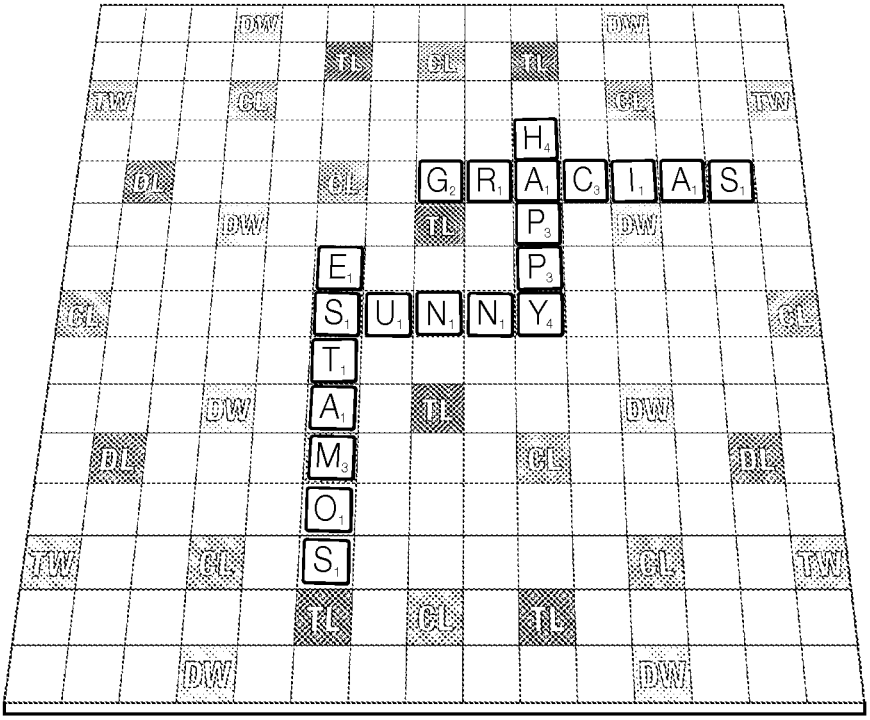

During game play, if the characters selected from the first language engages the one or more change language areas, the characters from the second or different language are subsequently used to build a word. For example, referring to FIGS. 2-7, the change language square or area is used to change from a first language to a second language. Referring to FIG. 2, the playing grid or playing environment has a series of squares for placing one or more characters. Referring to FIG. 3, characters, embodied in language tiles, are distributed to each player from one or more languages. It should be noted that this is an example of a non-digital version of the invention and that the same invention may be adapted for comparable use in a digital version in conjunction with a computer system or a combination digital and non-digital version. Referring to FIGS. 4-5, the playing grid has a word spelled out on the playing grid during game play where a CL (change language) square is covered changing the language from English to Spanish. It should be noted that this is merely an example of languages and that any language used or created in the world may be used with regards to the change language square. Referring to FIGS. 6-7, the playing grid is shown during game play where the CL square is covered again changing the language from Spanish to English on the next turn. It should be noted also that more than two languages may be used as selected by the players or randomly assigned.

In another embodiment, a software or digital version of the word building game may be provided for operation on a computer using a process or server. It should be noted that this is an example of a digital version of the invention and that the same invention may be adapted for non-digital version alone or combination with a digital version.

The players are allowed to create an online login and profile specifying the two or more languages in which they prefer to game play. When players login to the game, they may choose one, two, or three specific opponents or allow the computer to randomly select opponents matching the language profiles.

Each player may view a digital grid or playing environment depicting the playing board. The playing board or grid may consist of individual spaces or character areas in which to play words formed from their particular letter tiles. The playing grid will have a "change language" square (CL) or character area. When the CL is crossed while forming and playing a word the language of play must change to one other languages selected for that game. In one embodiment, the player crossing the CL square may also have the choice of the new language of play—but the language is changed. Other alternatives for choosing the change of language are contemplated including random assignment by the computer, by proxy by all of the players, preselected orders of change in advance of the game, or other alternatives. The new language of play may remain until another CL square is crossed or engaged. This invention forces the players to form words in different languages throughout the course of the game.

The computer, in another embodiment, may be programmed with the capability to provide play in all languages. Players may have the option of selecting the two or more languages in which they would like to play any specific game. Advance players may select two, three, four, or more languages for any specific game.

Each player may receive an equal number of digital character or letter tiles from the alphabets of the two or more languages that were selected for that particular game. The use of the computer to dispense digital or electronic tiles to each player will be programmed to select from the alphabets of the multiple languages chosen by the players for that game. Each letter tile may have a numeric value assigned to it. The computer will score the words being played according to these letter tile values. Each player, in sequential order, may form and play words in the language that is in force at the time of his play. After each player's turn, he will receive additional randomly selected letter tiles to replenish those played. The total number of tiles may be determined to allow sufficient rounds of play. The game will end when the letter tiles are exhausted.

The computer may store appropriate dictionaries for all of the multiple languages in which games may be played. The computer may be programmed to access only the dictionaries of the two or more languages for the specific game played. The computer may verify the acceptability of the words being played by accessing its stored dictionaries. For example, in a game where English and Spanish are selected as the languages of play, a player having the double "LL" of the Spanish alphabet may not use it to spell the English word "llamas" (requiring six letters). However, when the language of play is Spanish, he could use the double "LL" letter tile to spell the Spanish word "llamas" (translates to English as "flames") using 5 letter tiles. He would not be able to use 2 single "L" letter tiles for this word.

As a learning tool, each player could also select a translate option to appear on his device or computer. This option would allow them to see translations into any language of words that have already been played.

The multilingual tiles and the game board or grid are digital and played in an online multi-user environment. Hardware may include a logical processor and game software code to effect and operate the game on an online digital board or grid.

The game code and memory may store digital letter tiles and dictionaries for a plurality of languages. The game code may allow selection of two or more languages to be operated during play in any particular game recognizing that some letter tiles are language specific and may be dispensed only if that language is chosen as one of the languages for the particular game. Language specific tiles can only be played when that particular language is then operating language of play. For example, the Spanish double "LL" can only be played when the operating language is Spanish but cannot be played when the operating language is English. However, it can be played if and when the language is changed back to Spanish during that game.

A sample set of game rules for the word building game is as follows. Players will create a log-in profile listing the 2 or more languages in which they would like to play. When players log in to play a game they may choose one, two or three specific opponents or allow the server to randomly select one, two or three opponents with overlapping language profiles.

Just like the other online word games, players will receive a digital set of letter tiles to form words on the 15×15-square "board". The board will have a similar variety of bonus squares for letters and words—double or triple. But in addition to these regular bonus squares, the invention will have Change Language squares—CL squares. When a word is played across a Change Language square that player must select a new language for the next play(s), from the agreed languages for that game. The next player now has to form a word in the new language until another Change Language square is crossed and the language-of-play again changes. Existing words on the board do not change. The next player has to form and play a word in the "new" language-of-play.

Games can be played in multiple languages depending upon the language profile of the players. For instance, games may be played bilingually in English & Spanish; English & French; French & Italian; Italian & Spanish; etc. Games can become even more interesting and challenging as multiple languages are selected, for instance, English, French & Spanish; English, German & Italian; or English, French, German, Dutch & Spanish . . . as examples—whatever combination of languages the players select.

For example, a player challenges three friends/opponents to a game with English, Spanish and French as the languages chosen. English was randomly selected as the first language. Player 1 goes first and plays a word in English. Player 2 now plays a word in English that crosses a CL square. He now has to choose either Spanish or French for the new language. Let's say he chooses Spanish. Player 3 now has to play her/his word in Spanish. The language-of-play will stay in Spanish until a subsequent player plays a word crossing another CL square . . . and so on. Several languages have special characters—these characters (such as, the "ñ" in Spanish) can only be used when the language-of-play is in that particular language. If you have one of these language-specific characters you will have to develop a strategy to direct the language-of-play to the language that you would prefer.

A method of playing the word building game comprises one or more of the following steps. A first player receives characters comprising at least a first language and a second or different language. The characters of the first language and the characters of the second or different language are used non-simultaneously. The first player forms a word from the characters using the first language to form the word within a playing environment having a plurality of character areas. The plurality of character areas include one or more change language areas. A point value is counted for the word based on the numeric value of the characters used in the word. During game play, if the characters selected by the first player from the first language engages the one or more change language areas, the characters from the second or different language are subsequently used by a second player to build a word.

A computer-readable carrier contains instructions thereon for instructing a computing device to implement a word building game. For example, the carrier may be a DVD. The instructing includes one or of the following steps. A plurality of characters is provided comprising at least a first language and a second or different language. The characters of the first language and the characters of the second or different language are used non-simultaneously. The characters are distributed to the two or more players. In one embodiment, there are a range of players from one to four or even more. The characters are received from the players to form a word using a first language to form the word within a playing environment having a plurality of character areas. The plurality of character areas including one or more change language areas. A point value is counted for the word based on the numeric value of the characters used in the word. If the characters selected from the first language engages the one or more change language areas, the characters from the second or different language are subsequently used to build a word.

A computing apparatus provides a word building game. The computer apparatus is configured to provide the following steps. In one embodiment, the computer apparatus is selected from a group consisting of: smart phone, mobile phone, tablet, laptop, desktop computer, handheld device, portable device, server, and other electronic devices configured to operate a word building game. First, a plurality of characters comprising at least a first language and a second or different language are provided. The characters of the first language and the characters of the second or different language are used non-simultaneously. The characters are distributed to two or more players. The characters are received from the players to form a word using a first language within a playing environment having a plurality of character areas. The plurality of character areas include one or more change language areas. A point value is counted for the word based on the numeric value of the characters used in the word. During game play, if the characters selected from the first language engages the one or more change language areas, the characters from the second or different language are subsequently used to build a word.

It should be noted the methods, system, process, carrier and apparatus of the invention may be operated and performed with computer hardware, software, servers, computer system, database, network, internet, series of computers, handheld devices, smartphones, tablets, or similar.

Embodiments of the present invention may also include one or a multitude of internet based servers, and computer software, including internet web page based code, and methods of application for providing the user with an internet based service. Aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as "logic", or "system". Furthermore, aspects of the present invention may take the form of a computer program product embodied in one or more computer readable medium(s) having computer readable program code embodied thereon.

Embodiment of the present invention may operate on a network for providing a word building game system. By way of example, the system can be employed in conjunction with a computer-based system, where the elements can be implemented in hardware, software, firmware, or combinations thereof. Network may include computers or smart phones. Each of the computers or smart phones may be configured to communicate with an application server via internet connections. The server may include processors and memory for hosting different gaming modules, which are described in more detail above with respect to the detailed description of the exemplary implementation. Information or profiles can be stored in a database.

Any combination of one or more computer readable medium(s) or carriers may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The foregoing has outlined, in general, the complete detailed description of the physical process, and or methods of application of the invention and is to serve as an aid to better understanding the intended application and use of the invention disclosed herein. In reference to such, there is to be a clear understanding the present invention is not limited to the method or detail of construction, fabrication, material, or application of use described and illustrated herein. Any other variation of fabrication, use, or application should be considered apparent as an alternative embodiment of the present invention.

In the foregoing specification, the invention has been described with reference to specific embodiments. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature, or element, of any or all the claims.

It would be appreciated by those skilled in the art that various changes and modifications can be made to the illustrated embodiments without departing from the spirit of the present invention. All such modifications and changes are intended to be covered by the appended claims.

What is claimed is:

1. A method of operating a digital computing apparatus, including a storage medium, that permits at least a first player to play a word building game that requires said first player to use a first language that alternates back and forth with at least a second language throughout the course of the game, comprising the steps of:

creating a profile specifying at least two languages of the first player;

determining an opponent by matching a plurality of the at least two languages of the first player to a plurality of languages of the opponent;

storing in said storage medium a first dictionary containing words that are approved in said first language and a second dictionary containing words that are approved in said second language;

determining a first set of letters corresponding to the alphabet of the first language and a second set of letters corresponding to the alphabet of the second language;

displaying to said first player a digital grid that creates a playing environment, said digital grid comprising an array of rows and columns, wherein each of said rows and columns forms a plurality of 4-sided polygons, including a first set of said 4-sided polygons which contain a score-related indicia for adjusting the score of said first player during the course of the game, and a second set of said 4-sided polygons which contain a language-related indicia for instructing said first player to change the current language in force during the course of the game;

distributing to said first player, by said digital computing apparatus, an equal number of digital tiles that may be placed on said digital grid during game play and combined to form words in said first and second languages, where each digital tile includes a letter for either the first set of letters or the second set of letters and has an associated point value for scoring game play;

establishing, by said digital computing apparatus, said first language as the current language and said first player as a current player, to allow said first player to begin a word building game, wherein said first language alternates back and forth thereafter with said second language upon each next encounter with a polygon containing said language-related indicia;

placing tiles on said digital grid to form a digital word in the current language in force which becomes the current word once all tiles forming the digital word have been placed on the grid;

verifying, by said digital computing apparatus, the acceptability of said current word just placed on said digital grid, by accessing said storage medium to determine that said current word is among the approved words in the current language stored in said storage medium;

replenishing, by said digital computing apparatus upon successful verification of the current approved word, additional digital tiles selected to replace the tiles used to form the current approved word;

calculating, by said digital computing apparatus, a score for the current approved word being submitted for play by the current player, based in part on the total of said point values associated with each of the letters used to form said current approved word;

detecting, by said digital computing apparatus, formation of said current approved word across one of said second set of polygons that include said language-related indicia in order to instruct said first player, prior to forming the next digital word, to change the current language to said second language if said first language is currently in force, or otherwise, to said first language if said second language is currently in force; and changing, by said digital computing apparatus, the current language in force upon successful detection of said current approved word being formed across one of said second set of polygons.

2. A method of operating a digital computing apparatus, including a storage medium, that permits a first player and at least a second player to play a word building game that requires both players to use a first language that alternates back and forth with at least a second language throughout the course of the game, comprising the steps of:

creating a profile specifying at least two languages of the first player;

determining an opponent by matching a plurality of the at least two languages of the first player to a plurality of languages of the opponent;

storing in said storage medium a first dictionary containing words that are approved in said first language and a second dictionary containing words that are approved in said second language;

determining a first set of letters corresponding to the alphabet of the first language and a second set of letters corresponding to the alphabet of the second language;

displaying to said first and second players a digital grid that creates a playing environment, said digital grid comprising an array of rows and columns, wherein each of said rows and columns forms a plurality of 4-sided polygons, including a first set of said 4-sided polygons which contain a score-related indicia for adjusting the score of each player during the course of the game, and a second set of said 4-sided polygons which contain a language-related indicia for instructing both players to change the current language in force during the course of the game;

distributing to each player, by said digital computing apparatus, an equal number of digital tiles that may be placed on said digital grid during game play and combined to form words in said first and second languages, where each digital tile includes a letter for either the first set of letters or the second set of letters and an associated point value for scoring game play;

establishing, by said digital computing apparatus, said first language as the current language and said first player as a current player, to allow said first player to begin a word building game with said second player, wherein said first language alternates back and forth thereafter with said second language upon each next encounter with a polygon containing said language-related indicia;

placing tiles on said digital grid to form a digital word in the current language in force, which becomes the current word once all tiles forming the digital word have been placed on the grid;

verifying, by said digital computing apparatus, the acceptability of said current word just placed on said digital grid, by accessing said storage medium to determine that said current word is among the approved words in the current language stored in said storage medium;

replenishing, by said digital computing apparatus upon successful verification of the current approved word, additional digital tiles selected to replace the tiles used to form the current approved word;

calculating, by said digital computing apparatus, a score for the current approved word being submitted for play by the current player, based in part on the total of said point values associated with each of the letters used to form said current approved word;

detecting, by said digital computing apparatus, formation of said current approved word across one of said second set of polygons that include said language-related indicia in order to instruct both players, prior to forming the next digital word, to change the current language to said second language if said first language is currently in force, or otherwise, to said first language if said second language is currently in force; and changing, by said digital computing apparatus, the current language in force upon successful detection of said current approved word being formed across one of said second set of polygons, and the current player to said second player if the first player has just played, or back to said first player if the second player has just played.

3. A method of operating a digital computing apparatus, including a storage medium, that permits a first player and at least a second player to play a word building game that requires both players to use a first language that alternates back and forth with at least a second language throughout the course of the game, comprising the steps of:

creating a profile specifying at least two languages of the first player;

determining an opponent by matching a plurality of the at least two languages of the first player to a plurality of languages of the opponent;

storing in said storage medium a first dictionary containing words that are approved in said first language and a second dictionary containing words that are approved in said second language;

determining a first set of letters corresponding to the alphabet of the first language and a second set of letters corresponding to the alphabet of the second language;

displaying to said first and second players a digital grid that creates a playing environment, said digital grid comprising an array of rows and columns, wherein each of said rows and columns forms a plurality of 4-sided polygons, including a first set of said 4-sided polygons which contain a score-related indicia for adjusting the score of each player during the course of the game, and a second set of said 4-sided polygons which contain a language-related indicia for instructing both players to change the current language in force during the course of the game;

distributing to each player, by said digital computing apparatus, an equal number of digital tiles that may be placed on said digital grid during game play and combined to form words in said first and second languages, where each digital tile includes a letter for either the first set of letters or the second set of letters and has an associated point value for scoring game play;

establishing, by said digital computing apparatus, said first language as the current language and said first player as a current player, to allow said first player to begin a word building game with said second player, wherein said first language alternates back and forth thereafter with said second language upon each next encounter with a polygon containing said language-related indicia;

placing tiles on said digital grid to form a digital word in the current language in force, which becomes the current word once all tiles forming the digital word have been placed on the grid;

verifying, by said digital computing apparatus, the acceptability of said current word just placed on said digital grid, by accessing said storage medium to determine that said current word is among the approved words in the current language stored in said storage medium;

replenishing, by said digital computing apparatus upon successful verification of the current approved word, additional digital tiles selected to replace the tiles used to form the current approved word;

calculating, by said digital computing apparatus, a score for the current approved word being submitted for play by the current player, based in part on the total of said point values associated with each of the letters used to form said current approved word;

detecting, by said digital computing apparatus, formation of said current approved word across one of said second set of polygons that include said language-related indicia in order to instruct both players, prior to forming the next digital word, to change the current language to said second language if said first language is currently in force, or otherwise, to said first language if said second language is currently in force;

changing, by said digital computing apparatus, the current language in force upon successful detection of said current approved word being formed across one of said second set of polygons, and the current player to said second player if the first player has just played, or back to said first player if the second player has just played; and cycling repetitively through each round of game play including, for each player, repetition of at least the steps of placing, verifying, replenishing, calculating, detecting, and changing.

* * * * *